United States Patent [19]

Tamura

[11] Patent Number: 4,884,547

[45] Date of Patent: Dec. 5, 1989

[54] AIR/FUEL RATIO CONTROL SYSTEM FOR INTERNAL COMBUSTION ENGINE WITH VARIABLE CONTROL CHARACTERISTICS DEPENDING UPON PRECISION LEVEL OF CONTROL PARAMETER DATA

[75] Inventor: Hideyuki Tamura, Yokohama, Japan

[73] Assignee: Nissan Motor Company, Limited, Japan

[21] Appl. No.: 227,834

[22] Filed: Aug. 3, 1988

[30] Foreign Application Priority Data

Aug. 4, 1987 [JP] Japan ..... 62-119319[U]

[51] Int. Cl.[4] ..... F02D 41/14; F02M 51/00

[52] U.S. Cl. ..... 123/489; 123/488; 364/431.5

[58] Field of Search ..... 123/440, 478, 480, 486, 123/488, 489, 589; 364/431.5

[56] References Cited

U.S. PATENT DOCUMENTS

| | | | |
|---|---|---|---|
| 4,624,232 | 11/1986 | Saito et al. | 123/489 |
| 4,625,699 | 12/1986 | Kobayashi et al. | 123/489 |
| 4,651,700 | 3/1987 | Kobayashi et al. | 123/489 |
| 4,655,188 | 4/1987 | Tomisawa et al. | 123/489 |
| 4,669,439 | 6/1987 | Mamiya et al. | 123/489 |
| 4,730,594 | 3/1988 | Hibino et al. | 123/489 X |
| 4,738,238 | 4/1988 | Ohishi | 123/489 X |
| 4,741,312 | 5/1988 | Ohishi | 123/489 |

*Primary Examiner*—Willis R. Wolfe

*Attorney, Agent, or Firm*—Lowe, Price, LeBlanc, Becker & Shur

[57] ABSTRACT

An air/fuel ratio control system detects an air/fuel ratio indicative control parameter out of required precision range for initiating a control characteristics derivation process. The control characteristics derivation process is performed by varying constant consisting an air/fuel ratio dependent fuel delivery amount correction coefficient in trial basis to monitor fluctuation range of the correction coefficient. Based on the trial basis processings, the value of the constant is determined so as to compensate the precision level lowered in monitoring the air/fuel ratio.

14 Claims, 2 Drawing Sheets

AIR/FUEL RATIO CONTROL SYSTEM FOR INTERNAL COMBUSTION ENGINE WITH VARIABLE CONTROL CHARACTERISTICS DEPENDING UPON PRECISION LEVEL OF CONTROL PARAMETER DATA

BACKGROUND OF THE INVENTION

1. Field of the Invention

The present invention relates generally to an air/fuel ratio control system for an internal combustion engine for performing λ control in order to maintain air/fuel ratio close to stoichiometric value. More specifically, the invention relates to an air/fuel ratio control system which can avoid influence of lowering of precision of control parameter data.

2. Description of the Background Art

As is well known, an air/fuel ratio control for an air/fuel mixture to be introduced into an engine combustion chamber is performed by modifying a basic fuel delivery amount Tp, such as basic fuel injection amount, which is generally derived on the basis of an engine revolution speed and an engine load represented by an intake air flow rate, for example, by utilizing a correction coefficient derived on the basis of an oxygen concentration dependent control parameter derived by monitoring oxygen concentration in an exhaust gas. The correction coefficient variable depending upon the oxygen concentration in the exhaust gas will be hereafter referred to as α correction coefficient. The α correction coefficient is generally derived through PI (proportional-integral) control process. In the practical process, when the air/fuel ratio varies from rich to lean across a stoichiometric value, a lean mixture proportional component $P_L$ is used. On the other hand, when the air/fuel ratio varies from lean to rich across the stoichiometric value, a rich mixture proportional component $P_R$ is used.

On the other hand, an integral component is derived by integrating an integral constant over a period while the air/fuel mixture is maintained rich or lean. The integral constant to be used while the air/fuel mixture is held rich will be hereafter referred to as rich mixture integral constant $I_R$ and while the air/fuel mixture is held lean will be hereafter referred to as lean mixture integral constant $I_L$.

As will be appreciated, the proportional component as a fixed constant and the integral constant are variable depending upon the engine driving condition defined by engine speed, engine load and so forth.

In the normal state of the components constituting the air/fuel ratio control system and the engine is driven at substantially steady state, a threshold level corresponding to the stoichiometric value to distinguish rich mixture and lean mixture can be set at substantially mid point between a maximum value and minimum value of an oxygen concentration indicative values of an oxygen sensor in an exhaust system, which oxygen concentration indicative value cyclically fluctuates between rich mixture indicative maximum value and lean mixture indicative minimum value.

The oxygen sensor generally has a lag time to vary the oxygen concentration indicative value across the threshold level from actual variation of air/fuel ratio across the stoichiometric value. As long as the oxygen sensor operates in normal state, the lag times upon varying the air/fuel ratio from rich to lean and from lean to rich are substantially the same to one another.

Here, the oxygen sensor tends to subject secular variation for varying output characteristics and response characteristics. In case of the oxygen sensor utilizing a zirconia, secular variation is inclined to occur to lower responseability for air/fuel ratio variation from lean to rich, while maintaining responseability for air/fuel mixture variation from rich to lean. This causes shifting of the α correction coefficient to be shifted to the richer side to cause richer mixture to be supplied to the engine combustion chamber.

SUMMARY OF THE INVENTION

Therefore, it is an object of the present invention to avoid such influence of an oxygen sensor and whereby maintain an air/fuel mixture close to the stoichiometric value.

In order to accomplish the aforementioned and other objects, an air/fuel ratio control system, according to the present invention, detects an air/fuel ratio indicative control parameter out of required precision range for initiating a control characteristics derivation process. The control characteristics derivation process is performed by varying constant consisting an air/fuel ratio dependent fuel delivery amount correction coefficient in trial basis to monitor fluctuation range of the correction coefficient. Based on the trial basis processings, the value of the constant is determined so as to compensate the precision level lowered in monitoring the air/fuel ratio.

According to one aspect of the invention, an air/fuel ratio control system for an internal combustion engine, comprises first means for monitoring first engine driving parameter representative of basic fuel delivery control parameters to produce a first signal, second means for monitoring oxygen concentration in an exhaust gas to produce a second signal, third means for monitoring third engine driving parameter representative of an engine driving driving condition and a third signal, fourth means for deriving a basic fuel delivery amount on the basis of the first signal, fifth means for deriving a correction value for correcting the basic fuel delivery amount on the basis of the oxygen concentration, the correction value being variable according to a predetermined control characteristics, and sixth means for detecting a engine driving condition satisfying a predetermined updating condition to generate fixed value signals which defines a known control characteristics, obtaining the correction values derived with respect to the fixed value signals, and determining the control characteristics on the basis of the correction values obtained with respect to the fixed value signals.

Preferably, the fifth means derives the correction value with a predetermined constant which defines the control characteristics, and the sixth means adjusts the constant based on the correction values obtained with respect to the fixed value signals. In such case, the fifth means derives the correction value to vary across a predetermined value which correspond to a stoichiometric value of an air/fuel ratio, and the sixth means adjusts the constant so that a difference between the correction values obtained with respect to the fixed value signals, and the stoichiometric value representative predetermined value, is maintained constant.

The third means may monitor a vehicle driving speed and an engine load variation to produce the third signal indicative thereof, and the sixth means detects the engine driving condition in which the vehicle speed is maintained within a predetermined vehicle speed range and the engine load variation is substantially small as the engine driving condition satisfying the updating condition. The third means further detects the engine driving condition satisfying a predetermined feedback control control for performing λ control, and the sixth means is responsive to the third means detecting the engine driving condition satisfying the predetermined feedback condition as additional factor for satisfying the updating condition.

According to another aspect of the invention, an air/fuel ratio control system for an internal combustion engine, comprises an engine speed sensor for monitoring an engine revolution speed for producing an engine speed indicative signal, an engine load sensor for monitoring an engine load condition to produce an engine load indicative signal, an oxygen sensor for monitoring oxygen concentration in an exhaust gas to produce a rich/lean mixture indicative signal, an updating condition detector means for detecting an engine driving condition satisfying a predetermined updating condition to produce an updating command, first means for deriving a basic fuel delivery amount on the basis of the engine speed indicative signal and the engine load indicative signal, second means for deriving a correction value for correcting the basic fuel delivery amount on the basis of the rich/lean mixture indicative signal, the second means having a control constant values of which is variable and based on which the correction value is varied depending upon an interval between occurrence of inversion of the rich/lean mixture indicative signal between rich mixture indicative state and lean mixture indicative state, and third means for detecting a engine driving condition satisfying a predetermined updating condition to generate fixed value signals which are to be used in place of the control constant values, obtaining the correction values derived with respect to the fixed value signals, and updating the control constant values of the second means on the basis of the correction values obtained with respect to the fixed value signals.

According to a further aspect of the invention, an air/fuel ratio control system for an internal combustion engine, comprises an engine speed sensor for monitoring an engine revolution speed for producing an engine speed indicative signal, an engine load sensor for monitoring an engine load condition to produce an engine load indicative signal, an oxygen sensor for monitoring oxygen concentration in an exhaust gas to produce a rich/lean mixture indicative signal, an updating condition detector means for detecting an engine driving condition satisfying a predetermined updating condition to produce an updating command, first means for deriving a basic fuel delivery amount on the basis of the engine speed indicative signal and the engine load indicative signal, second means for deriving a correction value for correcting the basic fuel delivery amount on the basis of the rich/lean mixture indicative signal, which correction value contains a first lag factor upon changing values from rich mixture indicative state to lean mixture indicative state, a second lag factor upon changing values from lean mixture indicative state to rich mixture indicative state, and the second means having a first constant determining the first lag factor and a second constant determining the second lag factor, the second means varying the the correction value depending upon an interval between occurrence of inversion of the rich/lean mixture indicative signal between rich mixture indicative state and lean mixture indicative state by selectively utilizing the first and second constants, and third means for detecting a engine driving condition satisfying a predetermined updating condition to cyclically generate fixed value signals which are to be used in place of the constants, obtaining the correction values derived with respect to the fixed value signals, and updating the first and second constants of the second means on the basis of the correction values obtained with respect to the fixed value signals.

DESCRIPTION OF THE PREFERRED EMBODIMENT

Figure 1:
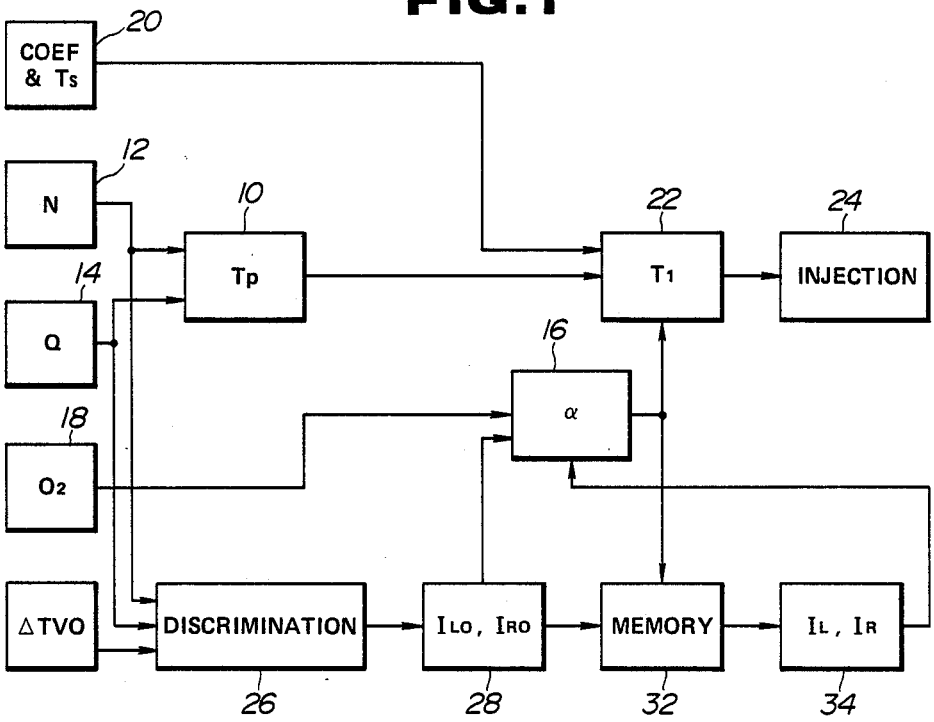
FIG. 1 is a block diagram of the preferred embodiment of an air/fuel ratio control system, according to the present invention.

Referring now to the drawings, particularly to FIG. 1, the preferred embodiment of an air/fuel ratio control system, according to the present invention, disclosed herebelow, is associated with a fuel injection control system for injecting a controlled amount of fuel to an air induction system of an internal combustion engine. Though the discussion given hereinbelow is concentrated for an air/fuel ratio dependent fuel injection amount control, it may be possible to apply the air/fuel ratio control, according to the present invention is applicable for any fuel delivery system, such as an electronically controlled carburator system and so forth.

The shown fuel injection control system is illustrated in discrete manner to show operations to be performed. However, it should be appreciated that a controller employed in the fuel injection control system, practically comprise a microprocessor programmed for performing fuel injection control and associated air/fuel ratio feedback control (λ control).

The fuel injection control system includes a basic fuel injection amount Tp derivation stage 10, in which is used an engine speed indicative data N as monitored by an engine speed detecting means 12, and an engine load data Q as monitored by an engine load detecting means 14. In practice, the engine speed detecting means 12 may comprise a known crank angle sensor which generates a crank reference signal at every predetermined crankshaft angular position and a crank position signal at every predetermined angle of crankshaft angular displacement. The engine speed detecting means 12 also includes an arithmetic engine speed derivation circuit. In case that the crank reference signal is used for derivation of the engine speed data N, a reciprocal of an interval of occurrences of the crank reference signals is used for derivation of the engine speed data. On the other hand, when the crank position signal is used, the engine speed derivation circuit may comprise an engine speed counter which counts given number of crank position signals and measures an elapsed period to count the given number of the crank position signals, or, in the alternative, which counts the crank position signals within a given period of time. In either case, the engine speed is derived on the basis of the frequency of occurrence of the crank position signal.

On the other hand, the engine load detecting means 14 generally comprises an air flow meter for monitoring intake air flow rate to produce an intake air flow rate indicative signal as the engine load indicative data. Though the intake air flow rate data is usually used as the engine load indicative data, it will not serve as exclusive element to form the engine load data. For example, an intake vacuum, a throttle angular position and so forth can also be taken as engine load indicative parameter. Furthermore, in the modern fuel injection control systems, there is a tendency of movement from the air flow rate data to the throttle angular position data to use as the engine load data. The throttle angular position data may be advantageously introduced as the engine load indicative parameter because it may not be influenced by pulsatile flow of the intake air.

As is well known, in the basic fuel injection amount derivation stage 10, a basic fuel injection amount Tp is derived by:

$$Tp=K\times N/Q \qquad \text{(K: constant)}$$

The basic fuel injection amount data Tp is thus output from the basic fuel injection amount derivation stage 10.

In order to perform λ control, an α correction coefficient derivation stage 16 is provided. The α correction coefficient derivation stage 16 is generally designed to derive the α correction coefficient on the basis of an oxygen concentration in an exhaust gas. In order to input an oxygen concentration data, an oxygen ($O_2$) sensor 18 is inserted into an exhaust passage to monitor the oxygen concentration to produce an $O_2$ signal. Generally, the α correction coefficient is derived on the basis of the $O_2$ signal. As is well known, the α correction coefficient is constituted of a proportional component (P) and an integral component (I).

Furthermore, other fuel injection amount correction factors are also monitored by various sensors, such as an engine coolant temperature sensor, a throttle angle sensor which serves as a sensor for detecting acceleration and deceleration demand, a vehicular battery voltage sensor and so forth, and which are generally labeled as correction factor detecting means 20. A correction coefficient (COEF and Ts) are derived by the correction factor detecting means 20, in which COEF is a combined correction coefficients, such as cold engine enrichment correction coefficient, an engine acceleration enrichment correction coefficient and so forth and Ts is a correction valve for compensating battery voltage.

The basic fuel injection amount data Tp, the α correction coefficient and the COEF correction coefficient and Ts correction value are used in a fuel injection amount (Ti) derivation stage 22. As is well known, the fuel injection amount Ti is determined by the following equation:

$$Ti=Tp\times COEF\times\alpha+Ts$$

The fuel injection amount Ti is then used for controlling fuel injection for injecting the controlled amount of fuel through a fuel injection valve in a fuel injection stage 24. As is well known, in the fuel injection stage 24, the fuel injection amount Ti is set in a Ti register in an output unit of the microprocessor for triggering a driver circuit at a predetermined timing in relation to the engine revolution cycle and maintains a valve actuator of the fuel injection valve at valve open position for a period corresponding to the fuel injection amount Ti.

Figure 2:
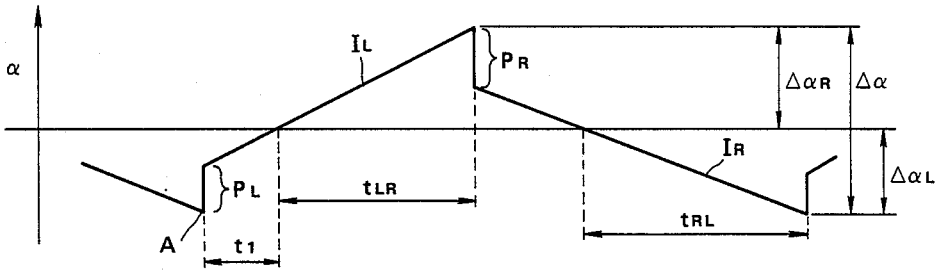
FIG. 2 is a timing chart showing variation of an air/fuel ratio dependent correction coefficient $\alpha$ to be utilized in λ control for controlling an air/fuel ratio close to a stoichiometric value.

Here, as seen from FIG. 2, when the engine is driven in steady state, the α correction coefficient cyclically varies according to rich/lean variation cycle of the air/fuel ratio. Variation range Δα, in which the α correction coefficient varies, is generally centered at a threshold level M corresponding to the stoichiometric value. As will be appreciated from FIG. 2, the α correction coefficient lags in a magnitude $t_{LR}$ and $t_{RL}$ from air/fuel ratio variation across the threshold level M. This lag time $t_{LR}$ and $t_{RL}$ is variable depending upon the inclination $I_L$ and $I_R$ which correspond integral constants in the I component of the α correction coefficient. The difference between α correction coefficient at point A and the threshold level M can be illustrated by $I_R\times t_{RL}$. From this, a period $t_1$ to reach the threshold level M from the point A can be illustrated by:

$$t_1=(I_R\times t_{RL}-P_L)/I_L$$

where $P_L$ is a lean mixture P component

From the above, the variation range Δα of the α correction coefficient can be illustrated by:

$$\begin{aligned}\Delta\alpha &= I_L\times(t_1+t_{LR})+PL\\ &= I_L\times\{(I_R\times t_{RL}-P_L)/I_L+t_{LR}\}+P_L\\ &= I_R\times t_{RL}+I_L\times t_{LR}\end{aligned}$$

Here, since the variation range Δα of the α correction coefficient can be practically detected, unknown lag times $t_{LR}$ and $t_{RL}$ can be derived by setting the integral constants $I_L$ and $I_R$ at known values. Assuming $I_L$ is $I_{LO}$ and $I_R$ is $a_{RO}$, can be illustrated by:

$$\Delta\alpha_0=I_{RO}\times t_{RL}+I_{LO}\times t_{LR} \qquad (1)$$

assuming $I^L$ is $I_{LO}/2$ and $I_R$ is $I_{RO}$, $$\Delta\alpha_1=I_{RO}\times t_{RL}+\tfrac{1}{2}\times I_{LO}\times t_{LR} \qquad (2)$$

assuming $I^L$ is $I_{LO}$ and $I_R/2$ is $I_{RO}$, $$\Delta\alpha_2=\tfrac{1}{2}\times I_{RO}\times t_{RL}+I_{LO}\times t_{LR} \qquad (3)$$

From the equations (1) and (2), the lag time $t_{LR}$ can be illustrated by:

$$t_{LR}=\{2\times(\Delta\alpha_0-\Delta\alpha_1)\}/I_{LO}$$

and, from equation (1) and (3), the lag time $t_{RL}$ can be illustrated by:

$$t_{RL}=\{2\times(\Delta\alpha_0-\Delta\alpha_2)\}/I_{RO}$$

In order to avoid influence of the secular variation of the $O_2$ sensor, it becomes necessary to maintain overshooting magnitudes $\Delta\alpha_R$ and $\Delta\alpha_L$ constant irrespective of the variation of response characteristics of the $O_2$ sensor relative to variation of the oxygen concentration in the exhaust gas. Therefore, by adjusting the integral constants $I_L$ and $I_R$ so that the $\Delta\alpha_R$ ($=I_L\times t_{LR}$) and $\Delta\alpha_L$ ($=I_R\times t_{RL}$) are maintained constant, overshooting magnitude can be maintained constant. The integral constant can be determined by:

$$I_L=\Delta\alpha_R/t_{LR}=K_1/(\Delta\alpha_0-\Delta\alpha_1) \qquad (4)$$

$$I_R = \Delta\alpha_L / t_{RL} = K_2 / (\Delta\alpha_0 - \Delta\alpha_2) \quad (5)$$

where $K_1$ and $K_2$ are constant

In order to determine or update the integral constant so that overshooting magnitude relative to the stoichiometric value representative threshold M, the preferred embodiment of the fuel injection control system, illustrated in FIG. 1, has an engine driving condition discriminating state 26, in which the engine driving condition satisfying a predetermined condition for updating the integral constant is detected. In the shown embodiment, the engine speed data N, the basic fuel injection amount Tp and a throttle angle variation rate ΔTVO are taken as parameter for discriminating the engine driving condition satisfying the predetermined updating condition. In practice, the updating of the integral constant is to be performed in the vehicular driving condition at not so high speed and in steady engine driving state. For example, the updating of the integral constant is enabled when the vehicle speed is in a range of 20 km/h to 40 km/h, and the engine driving condition is in steady condition.

When the engine driving condition satisfying the predetermined updating condition is detected in the engine driving condition discriminator stage 26, a preset constant generator stage 28 is enabled to generate preset integral constant. The preset integral constant to be generated by the preset constant generator stage 28 corresponds the integral constants used in the foregoing equations (1), (2) and (3). The generated integral constants are fed to the α correction coefficient derivation stage 16. The α correction coefficient derivation stage 16 derives the α correction coefficient including rich mixture correction coefficient and lean mixture correction coefficient. The derived rich mixture α correction coefficient and lean mixture α correction coefficient are processed in an α correction coefficient variation range derivation stage 30 to derive $\Delta\alpha_0$, $\Delta\alpha_1$ and $\Delta\alpha_2$ from the equations (1), (2) and (3). The derived values $\Delta\alpha_0$, $\Delta\alpha_1$ and $\Delta\alpha_2$ are stored in a memory 32 in order. When all of the values $\Delta\alpha_0$, $\Delta\alpha_1$ and $\Delta\alpha_2$ are stored, an integral constant derivation stage 34 becomes active to derive the integral constants $I_L$ and $I_R$ which can maintain the overshooting magnitudes $\Delta\alpha_L$ and $\Delta\alpha_R$ constant according to the foregoing equations (4) and (5).

The integral constants $I_L$ and $I_R$ thus derived are fed to the α correction coefficient stage 16, so that the α correction coefficient can be derived utilizing the updated integrated constants.

Figure 3:
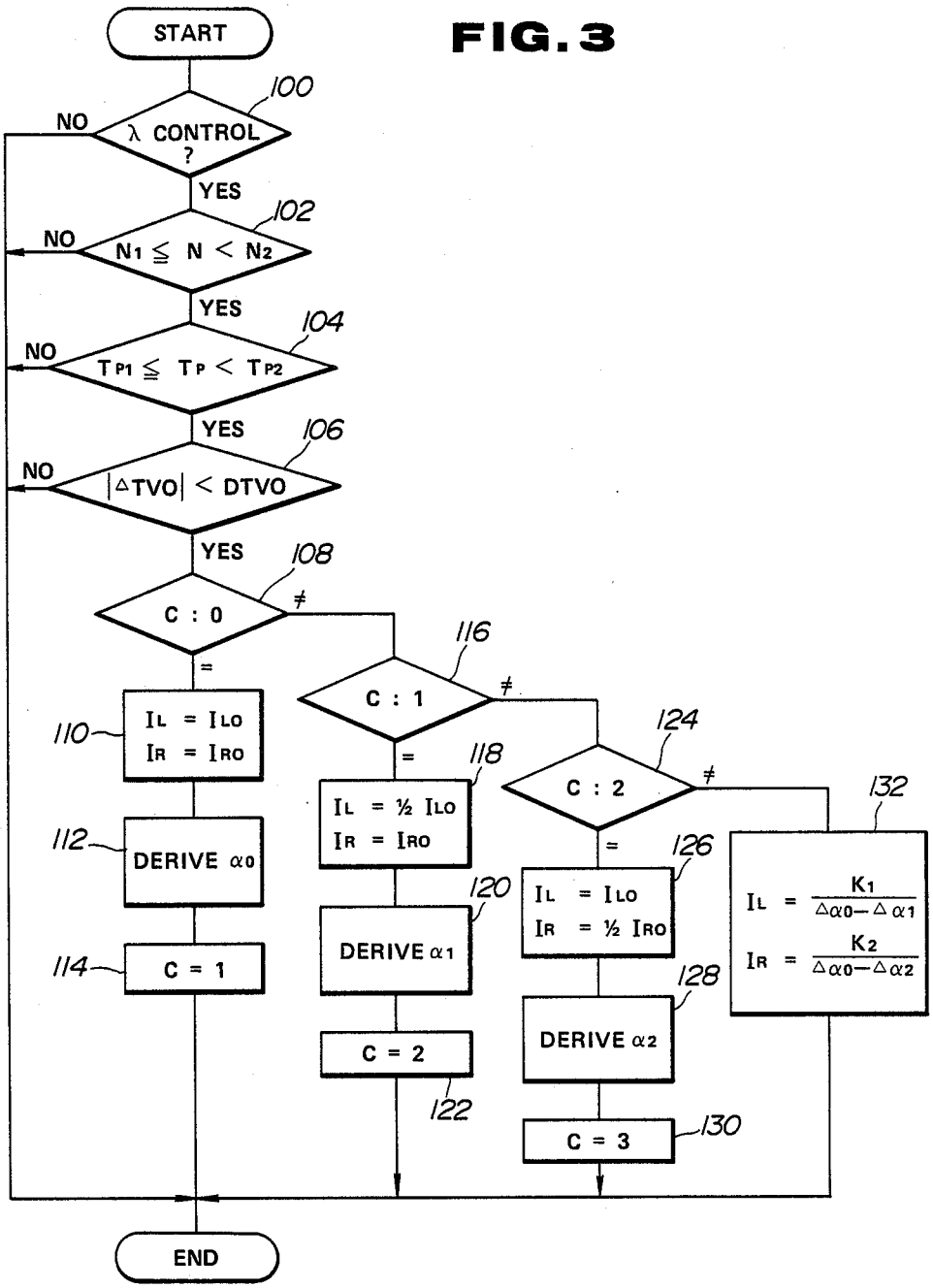
FIG. 3 is a flowchart showing a routine for deriving an air/fuel ratio dependent correction coefficient.

Practical operation in deriving the α correction coefficient with introducing the algorithm in deriving the integral constants, will be disclosed herebelow with reference to FIG. 3.

Immediately after starting execution, check is performed whether λ control condition is satisfied, at a step 100. The λ control condition is generally set at stable engine driving condition, in which the engine load variation is maintained substantially small. When the engine driving condition satisfying the λ control condition is detected as checked at the step 100. The engine speed data N is checked whether the engine speed is in a predetermined range defined by upper and lower engine speed reference values $N_2$ and $N_1$, at a step 102. When the engine speed data N is greater than or equal to the lower engine reference value $N_1$ and smaller than the upper engine speed reference $N_2$, as checked at the step 102, the basic fuel injection amount Tp is checked whether it is within a predetermined Tp value range defined by a upper and lower Tp reference values $Tp_1$ and $Tp_2$. When the basic fuel injection amount Tp is greater than or equal to the lower Tp reference value $Tp_1$ and smaller than the upper Tp reference value $Tp_2$, as checked at the step 104, a throttle angle variation rate ΔTVO is checked whether it is smaller than a predetermined throttle angle variation threshold DTVO, at a step 106.

These steps 100 to 106 are designed for detecting the engine driving condition suitable for performing checking of the $O_2$ sensor and updating of the integral constant. This condition will be hereafter referred to as "λ control constant updating condition". Namely, the λ control constant updating condition is that:

the engine speed N is within a given engine speed range, e.g. 20 km/h to 40 km/h;

the engine load condition as represented by the basic fuel injection amount Tp is within a given engine load range; and the throttle angle variation rate ΔTVO is smaller than a given throttle angle variation threshold DTVO.

The later two factors represent steady state of the engine driving condition.

When the engine driving condition satisfying the the λ control constant updating condition is detected through the steps 100 to 106, counter value C which counts up the λ control constant updating cycle and is reset every occurrence of engine starting up, is compared with zero, at a step 108. Namely, the counter value is reset to zero every occurrence of HIGH level starter switch signal. When the updating cycle counter value C as checked at the step 108 is equal zero, the rich mixture integral value $I_R$ and the lean mixture integral value $I_L$ are respectively set at $I_{RO}$ and $I_{LO}$, at a step 110. Then, the α correction coefficient variation range $\Delta\alpha_0$ is derived by deriving the rich mixture α correction coefficient $\Delta\alpha_R$ and the lean mixture α correction coefficient $\Delta\alpha_L$, at a step 112. The derived α correction coefficient variation range $\Delta\alpha_0$ is stored in the memory 30. Thereafter, the updating cycle counter value C is incremented by 1, at a step 114.

On the other hand, when the cycle counter value C is not zero as checked at the step 108, the cycle counter value is compared with one (1), at a step 116. When the updating cycle counter value C as checked at the step 116 is equal one, the rich mixture integral value $I_R$ and the lean mixture integral value $I_L$ are respectively set at $I_{RO}$ and $\frac{1}{2} \times I_{LO}$, at a step 118. Then, the α correction coefficient variation range $\Delta\alpha_1$ is derived by deriving the rich mixture α correction coefficient $\Delta\alpha_R$ and the lean mixture α correction coefficient $\Delta\alpha_L$, at a step 120. The derived α correction coefficient variation range $\Delta\alpha_1$ is stored in the memory 30. Thereafter, the updating cycle counter value C is incremented by 1, at a step 122.

When the cycle counter value C is not one as checked at the step 116, the cycle counter value is compared with two (2), at a step 124. When the updating cycle counter value C as checked at the step 124 is equal two, the rich mixture integral value $I_R$ and the lean mixture integral value $I_L$ are respectively set at $\frac{1}{2} \times I_{RO}$ and $I_{LO}$, at a step 126. Then, the α correction coefficient variation range $\Delta\alpha_2$ is derived by deriving the rich mixture α correction coefficient $\Delta\alpha_R$ and the lean mixture α correction coefficient $\Delta\alpha_L$, at a step 128. The derived α correction coefficient variation range $\Delta\alpha_2$ is stored in the memory 30. Thereafter, the updating cycle counter value C is incremented by 1, at a step 130.

Then, at a step 132, the rich mixture integral constant $I_R$ and the lean mixture integral constant $I_L$ are derived on the basis of the derived values $\Delta\alpha_0$, $\Delta\alpha_1$ and $\Delta\alpha_2$, according to the equations (4) and (5) set forth above.

As will be appreciated herefrom, the present invention successfully avoiding influence of the secular variation of the $O_2$ sensor and can prevent the air/fuel ratio from being inclined to richer side which may results in degradation of the emission control performance and fuel economy.

What is claimed is:

1. An air/fuel ratio control system for an internal combustion engine, comprising:

first means for monitoring first engine driving parameter representative of basic fuel delivery control parameters to produce a first signal;

second means for monitoring oxygen concentration in an exhaust gas to produce a second signal;

third means for monitoring third engine driving parameter representative of an engine driving condition and a third signal;

fourth means for deriving a basic fuel delivery amount on the basis of said first signal;

fifth means for deriving a correction value for correcting said basic fuel delivery amount on the basis of said oxygen concentration, said correction value being variable according to a predetermined control characteristics; and sixth means for detecting an engine driving condition satisfying a predetermined updating condition to generate fixed value signals which defines a known control characteristic, obtaining said correction value derived with respect to said fixed value signals, and determining said control characteristic on the basis of said correction value obtained with respect to said fixed value signals.

2. An air/fuel ratio control system as set forth in claim 1, wherein said fifth means derives said correction value with a predetermined constant which defines said control characteristic, and said sixth means adjusts said constant based on said correction value obtained with respect to said fixed value signals.

3. An air/fuel ratio control system as set forth in claim 2, wherein said fifth means derives said correction value to vary across a predetermined value which correspond to a stoichiometric value of an air/fuel ratio, and said sixth means adjusts said constant so that a difference between the correction value obtained with respect to said fixed value signals, and said stoichiometric value representative predetermined value, is maintained constant.

4. An air/fuel ratio control system as set forth in claim 1, wherein said third means monitors a vehicle driving speed and an engine load variation to produce said third signal indicative thereof, and said sixth means detects the engine driving condition in which the vehicle speed is maintained within a predetermined vehicle speed range and the engine load variation is substantially small as the engine driving condition satisfying said updating condition.

5. An air/fuel ratio control system as set forth in claim 4, wherein said third means further detects the engine driving condition satisfying a predetermined feedback control control for performing λ control, and said sixth means is responsive to said third means detecting the engine driving condition satisfying said predetermined feedback condition as additional factor for satisfying said updating condition.

6. An air/fuel ratio control system for an internal combustion engine, comprising:

an engine speed sensor for monitoring an engine revolution speed for producing an engine speed indicative signal;

an engine load sensor for monitoring an engine load condition to produce an engine load indicative signal;

an oxygen sensor for monitoring oxygen concentration in an exhaust gas to produce a rich/lean mixture indicative signal;

an updating condition detector means for detecting an engine driving condition satisfying a predetermined updating condition to produce an updating command;

first means for deriving a basic fuel delivery amount on the basis of said engine speed indicative signal and said engine load indicative signal;

second means for deriving a correction value for correcting said basic fuel delivery amount on the basis of said rich/lean mixture indicative signal, said second means having a control constant value of which is variable and based on which said correction value is varied depending upon an interval between occurrence of inversion of said rich/lean mixture indicative signal between rich mixture indicative state and lean mixture indicative state; and third means for detecting a engine driving condition satisfying a predetermined updating condition to generate fixed value signals which are to be used in place of said control constant value, obtaining said correction value derived with respect to said fixed value signals, and updating said control constant value of said second means on the basis of said correction value obtained with respect to said fixed value signals.

7. An air/fuel ratio control system as set forth in claim 6, wherein said second means derives said correction value to vary across a predetermined value which correspond to a stoichiometric value of an air/fuel ratio, and said third means adjusts said constant value so that a difference between the correction value obtained with respect to said fixed value signals, and said stoichiometric value representative predetermined value, is maintained constant.

8. An air/fuel ratio control system as set forth in claim 6, wherein said updating condition detector means detects the engine driving condition in which the vehicle speed is maintained within a predetermined vehicle speed range and the engine load variation is substantially small as the engine driving condition satisfying said updating condition to produce said updating command indicative of the engine driving condition satisfying said predetermined updating condition.

9. An air/fuel ratio control system as set forth in claim 8, wherein said updating condition detector means further detects the engine driving condition satisfying a predetermined feedback control control for performing λ control, and said third means is responsive to said third means detecting the engine driving condition satisfying said predetermined feedback condition as additional factor for satisfying said updating condition.

10. An air/fuel ratio control system for an internal combustion engine, comprising:

an engine speed sensor for monitoring an engine revolution speed for producing an engine speed indicative signal;

an engine load sensor for monitoring an engine load condition to produce an engine load indicative signal;

an oxygen sensor for monitoring oxygen concentration in an exhaust gas to produce a rich/lean mixture indicative signal;

an updating condition detector means for detecting an engine driving condition satisfying a predetermined updating condition to produce an updating command;

first means for deriving a basic fuel delivery amount on the basis of said engine speed indicative signal and said engine load indicative signal;

second means for deriving a correction value for correcting said basic fuel delivery amount on the basis of said rich/lean mixture indicative signal, which correction value contains a first lag factor upon changing values from rich mixture indicative state to lean mixture indicative state, a second lag factor upon changing values from lean mixture indicative state to rich mixture indicative state, and said second means having a first constant determining said first lag factor and a second constant determining said second lag factor, said second means varying said said correction value depending upon an interval between occurrence of inversion of said rich/lean mixture indicative signal between rich mixture indicative state and lean mixture indicative state by selectively utilizing said first and second constants; and third means for detecting a engine driving condition satisfying a predetermined updating condition to cyclically generate fixed value signals which are to be used in place of said constants, obtaining said correction value derived with respect to said fixed value signals, and updating said first and second constants of said second means on the basis of said correction value obtained with respect to said fixed value signals.

11. An air/fuel ratio control system as set forth in claim 10, wherein said fifth means derives said correction value with a predetermined constant which defines a known characteristic, and said sixth means adjusts said constant based on said correction value obtained with respect to said fixed value signals.

12. An air/fuel ratio control system as set forth in claim 11, wherein said fifth means derives said correction value to vary across a predetermined value which correspond to a stoichiometric value of an air/fuel ratio, and said sixth means adjusts said constant so that a difference between the correction value obtained with respect to said fixed value signals, and said stoichiometric value respresentative predetermined value, is maintained constant.

13. An air/fuel ratio control system as set forth in claim 10, wherein said third means monitors a vehicle driving speed and an engine load variation to produce said third signal indicative thereof, and said sixth means detects the engine driving condition in which the vehicle speed is maintained within a predetermined vehicle speed range and the engine load variation is substantially small as the engine driving condition satisfying said updating condition.

14. An air/fuel ratio control system as set forth in claim 13, wherein said third means further detects the engine driving condition satisfying a predetermined feedback control control for performing λ control, and said sixth means is responsive to said third means detecting the engine driving condition satisfying said predetermined feedback condition as additional factor for satisfying said updating condition.

* * * * *